US008905069B2

(12) United States Patent
Ike

(10) Patent No.: US 8,905,069 B2
(45) **Date of Patent: *Dec. 9, 2014**

(54) FLUID STORAGE AND PUMPING ASSEMBLY FOR FIRE PREVENTION AND PROTECTION

(71) Applicant: Gary Ike, Vancouver, WA (US)

(72) Inventor: Gary Ike, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/109,674

(22) Filed: Dec. 17, 2013

(65) Prior Publication Data

US 2014/0102564 A1 Apr. 17, 2014

Related U.S. Application Data

(63) Continuation of application No. 13/046,511, filed on Mar. 11, 2011, now Pat. No. 8,678,032.

(60) Provisional application No. 61/312,973, filed on Mar. 11, 2010.

(51) Int. Cl.
*A62C 35/68* (2006.01)
*F17D 1/08* (2006.01)

(52) U.S. Cl.
CPC .. *F17D 1/08* (2013.01); *A62C 35/68* (2013.01)
USPC ..... 137/565.17; 169/13; 220/565

(58) Field of Classification Search
USPC ..... 137/565.17, 565.18, 565.19, 565.34, 137/899.4; 169/13; 220/565; 222/383.1
See application file for complete search history.

(56) References Cited

U.S. PATENT DOCUMENTS

| | | | | |
|---|---|---|---|---|
| 1,694,806 | A | 12/1928 | Yale | |
| 1,998,025 | A | 4/1935 | Reaney | |
| 2,036,098 | A | 3/1936 | Pieper | |
| 2,832,569 | A | 4/1958 | Lewis | |
| 3,653,395 | A | 4/1972 | Chapman | |
| 4,491,150 | A | 1/1985 | Holman | |
| 4,917,193 | A | 4/1990 | Ockler | |
| 5,477,881 | A | 12/1995 | Fujinaka | |
| 7,168,443 | B2 | 1/2007 | Smith | |
| 7,845,424 | B1 | 12/2010 | Miller | |
| 8,678,032 | B2 * | 3/2014 | Ike | 137/565.17 |
| 2011/0247709 | A1 | 10/2011 | Daneshgari | |
| 2011/0284094 | A1 | 11/2011 | Chilcoat | |

* cited by examiner

*Primary Examiner* — John Rivell
(74) *Attorney, Agent, or Firm* — Stolowitz Ford Cowger LLP

(57) ABSTRACT

A method and apparatus for fluid storage and pumping comprising a fluid storage tank incorporating a housing cavity.

15 Claims, 11 Drawing Sheets

FLUID STORAGE AND PUMPING ASSEMBLY FOR FIRE PREVENTION AND PROTECTION

RELATED UNITED STATES PATENT APPLICATIONS

This application is a continuation of U.S. patent application Ser. No. 13/046,511, filed on Mar. 11, 2011, entitled "FLUID STORAGE AND PUMPING ASSEMBLY FOR FIRE PREVENTION AND PROTECTION," and claims priority to provisional U.S. Patent Application No. 61/312,973, filed on Mar. 11, 2010, entitled "FLUID STORAGE AND PUMPING ASSEMBLY FOR FIRE PREVENTION AND PROTECTION," each of which is incorporated by reference herein in its entirety.

TECHNICAL FIELD

The present device relates generally to a fluid storage and embedded pumping assembly for delivering pressurized fluid to a commercial or residential fire sprinkler system or domestic plumbing system.

RELATED ART

Fire sprinkler systems built according to the standard for the installation of sprinkler systems in one and two family dwellings and manufactured homes require a dependable water supply. It is often the case that the normal water supply line from a water well or from a city or community water system lacks an adequate volume of flow, pressure, or both to satisfy the demand requirement of a residential fire sprinkler system designed to meet the requirements of the NFPA-13d standard.

If the "normal" water supply is not sufficient, the standard NFPA-13d allows the installation of an adequately sized water storage tank and pump. The code does not specify the type of pump or address the nature or construction of the electrical supply or the electrical controls pertaining to the reliable automatic operation of the pump in its role of being the sole source of water pressure and quantity to the fire sprinkler system. Furthermore, the code does not specifically address the requirements for the storage tank except that it must contain enough water to satisfy the maximum sprinkler demand for a minimum of 10 minutes in most installations and 7 minutes in others.

A typical pump installation for a conventional residential sprinkler system conforming to the NFPA-13d standard consists of a commercial quality close coupled centrifugal pump installed by a residential fire sprinkler contractor. Conventional residential fire sprinkler pump systems are often haphazard, unwieldy and usually fail to provide any protective measures to prevent rapid start/stop cycling of the pump and motor caused by hydraulic pulsing in the sprinkler piping.

Furthermore, polyethylene water storage tanks commonly available and installed in residential fire sprinkler systems have been designed for general purposes and not specifically for installation in residential structures where floor space is at a premium. Additionally, many codes require electrical components to be located above floor grade, resulting in many pumps having to be located upon some kind of fabricated steel stand. Additionally, the pump is located next to the storage tank requiring additional floor space to be allocated to the installation.

DETAILED DESCRIPTION

Several examples of the present application will now be described with reference to the accompanying drawings. Various other examples of the invention are also possible and practical. This application may be exemplified in many different forms and should not be construed as being limited to the examples set forth herein.

The figures listed above illustrate various examples of the application and the operation of such examples. In the figures, the size of the boxes is not intended to represent the size of the various physical components.

Only those parts of the various units are shown and described which are necessary to convey an understanding of the examples to those skilled in the art.

Figure 1:
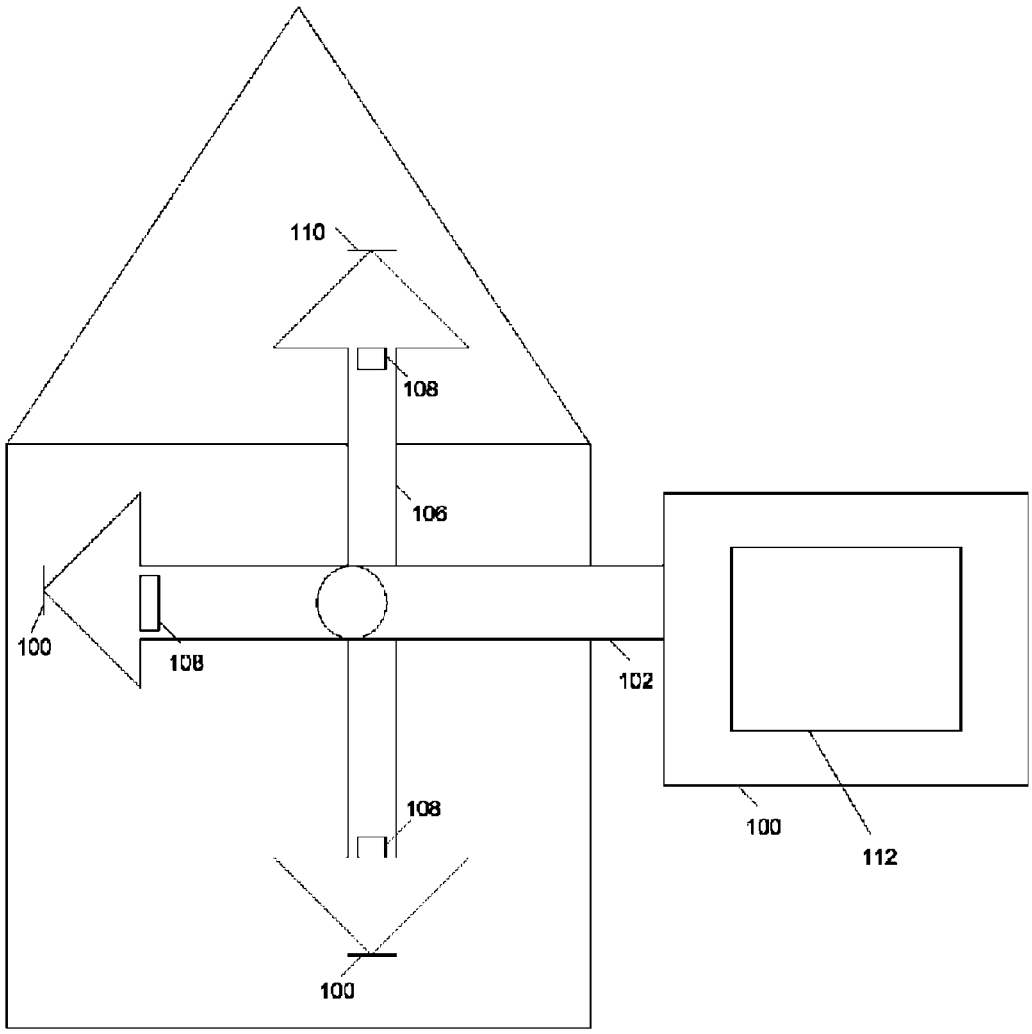
FIG. 1 illustrates embodiment of an embedded pump and storage assembly integrated with a residential home sprinkler system.

FIG. 1 depicts an embedded pump and fluid storage system 100 integrated with a sprinkler system 102 comprising a distribution system including piping 106, one or more pressure gauges 108 for detecting pressure within the distribution system piping 106 and sprinkler heads 110.

In one embodiment, pump and storage system 100 may comprise an embedded pumping assembly 112 to store, pressurize, and supply fluid (e.g., water) to sprinkler system 102 which may comprise: (1) a commercial fire sprinkler system and/or (2) a residential combined plumbing/fire sprinkler system.

Figure 2:
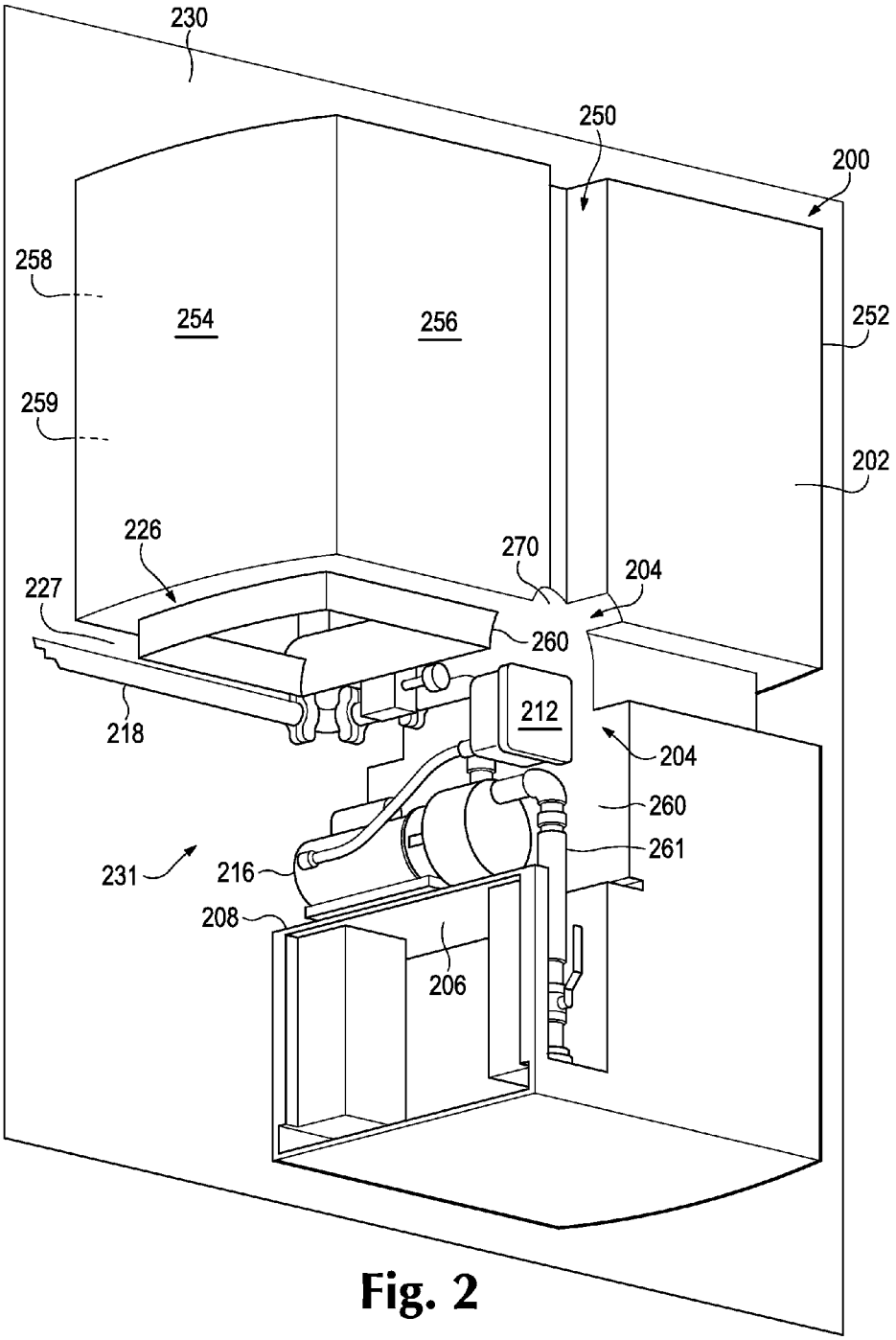
FIG. 2 illustrates an embodiment of an embedded pump and storage assembly.

FIG. 2 illustrates a cross-sectional side view of an embodiment of an embedded pump and fluid storage system 200 comprising a fluid storage chamber 202 and electrical pump 216.

In one embodiment a fluid storage and embedded pumping assembly 231 may be configured for delivering pressurized fluid to a residential fire sprinkler system and/or domestic plumbing system. Assembly 231 may be configured for reducing field assembly requirements in order to build a working fluid storage and delivery system 200 such as that depicted in FIG. 1.

In one embodiment, the embedded pump and fluid storage system 200 includes at least one fluid storage chamber 202 incorporating a housing cavity 204 defining a support base 206 and integrated mounting platform 208 upon which to dispose a pump assembly 231. In one embodiment, the pump assembly may include a pressure booster embedded pump 216.

In one embodiment, housing cavity 204 may bisect the fluid storage chamber 202 creating a bisecting horizontal passageway through the fluid storage chamber 202. Housing cavity 204 may have two vertical interior walls 260 and a curved inner top surface 270. In another embodiment, housing cavity 204 may reside in an aperture on an exterior surface 256 of fluid storage chamber 202. In such an embodiment, the platform 208 may reside in housing cavity 204 within the aperture wherein the pump assembly 231 is exposed on one side.

With an integrated mounting platform 208 for the pump 216 and electrical control system 212, components may be housed within a housing cavity 204 embedded in the fluid storage chamber 202 so that the components may be stored within the housing cavity 204 rather than on a floor or on a stand next to the fluid storage chamber 202 taking up limited floor space.

Such an arrangement may be disposed such that the mounting platform 208 is fixed at a particular height with respect to the ground meeting electrical component specifications required by code. In this way, pump and storage system 200 may be installed without an additional code compliant external stand for the pump 216.

In a particular embodiment, one or more support channels 250 and/or housing cavity 204 may provide structural support to the fluid storage chamber 202 enabling the fluid storage chamber 202 to maintain structural integrity without use of additional metal framework. In one embodiment, the channels 250 and 226 may provide routing for ingress and/or egress of various components of the embedded pumping assembly, such as, for instance the discharge pipe 218 or suction pipe 261. In one embodiment, housing cavity 204 may be designed to provide structural support for a fluid storage chamber 202 to prevent or deter deformity in fluid storage chamber 202 sidewalls 253, 254 and 256 (fourth wall 258 indicated). Additionally, housing cavity 204 may include mounting platform 208 for supporting the pump 216/electrical control 212 at a particular height. In some embodiments, the height is code compliant.

In one embodiment, the fluid storage chamber 202 may be configured to include one or more discharge channels 226 disposed within an outside surface 259 of the fluid storage chamber 202 wherein one or more channel apertures 227 open to the outside surface of the fluid storage chamber 202. The discharge piping 218 may be substantially disposed within the one or more channels 226.

In a particular embodiment, when discharge pipe 218 is disposed within the one or more channels 226 it may not extend substantially beyond the plane of a channel aperture 227 opening defined by the outside surface 259 of wall 258 of the fluid storage chamber 202. This may minimize the footprint of the system and/or contribute to the overall aesthetic appearance of the system 200. The discharge pipe 218 may be made of any of a variety of appropriate materials known to those of skill in the art, such as rubber, plastic, polyvinylchloride (pvc) and/or copper, for instance.

In one embodiment, a discharge pipe 218 may be adapted such that the direction of discharge may be oriented in the optimum direction for the given placement of the system within the structure. In one embodiment, the fluid storage chamber 202 may be disposed flush against a wall 230. Discharge pipe 218 may be disposed in a discharge channel 226 such that the discharge pipe 218 may be routed parallel to the wall and out of view because the discharge including, for instance, discharge pipe 218 or suction pipe channel 226 is disposed within the fluid storage chamber 202 and hidden from view behind the fluid storage chamber 202.

Figure 3:
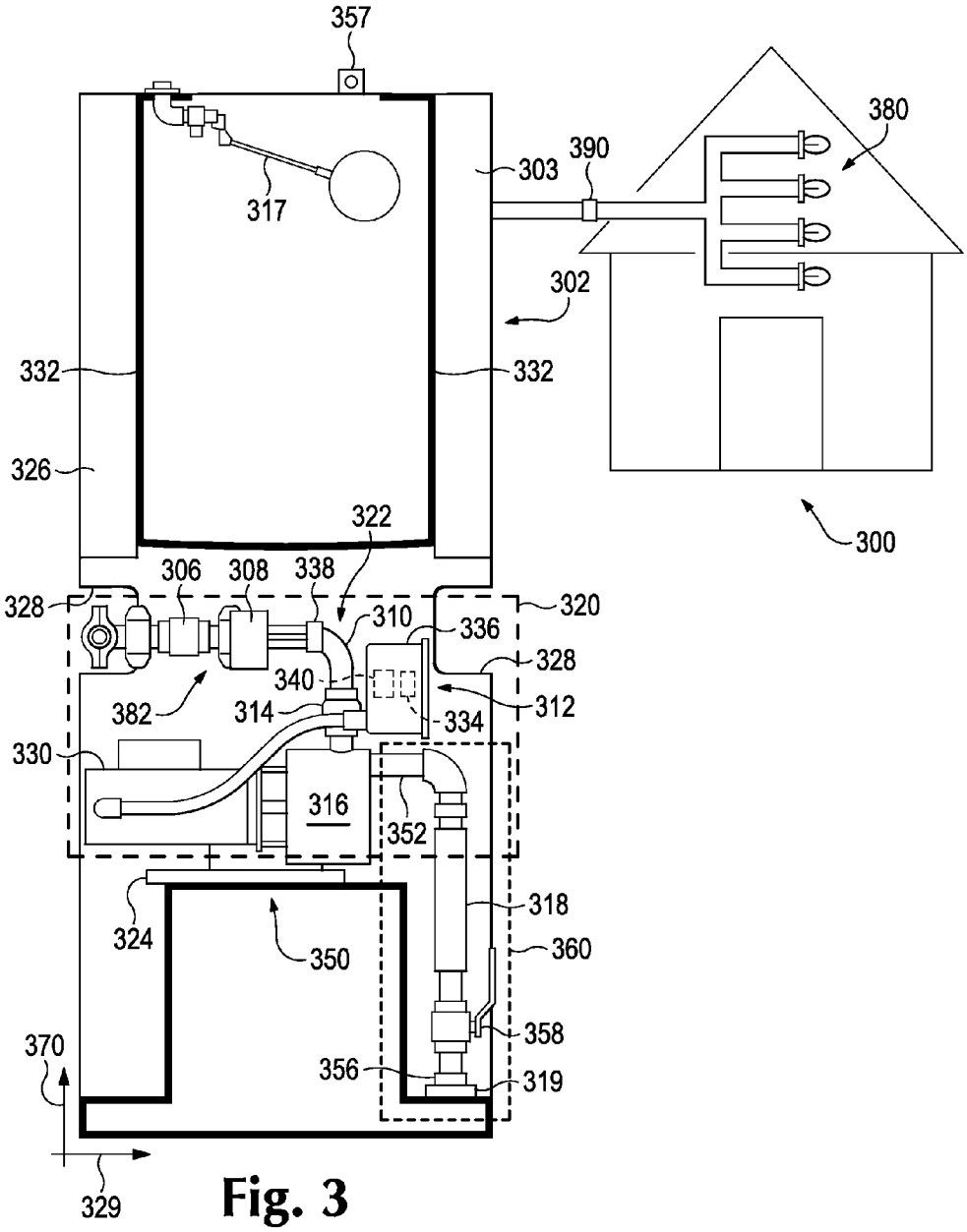
FIG. 3 illustrates embodiment of an embedded pump and storage assembly integrated with a residential home sprinkler system.

Referring now to FIG. 3 depicting an embodiment of an embedded pump and fluid storage system 300 in a ¾ cross-sectional oblique view. System 300 includes a pressure booster embedded pump system 320. Electrical control 312 may drive the embedded pump assembly 350. In one embodiment, the electrical control 312 may be integrated with the embedded pump and fluid storage system 300 and comprise means to prevent rapid start/stop cycling of the pump motor 330 as described in greater detail below. In one embodiment, the pump 316 starts responsive to a signal from the pressure switch 308. When the pump starts and flow occurs, the flow switch (illustrated as element 712 in FIG. 7,) activates and maintains the pump in an on state, (even if the pressure switch is de-activated) as long as there is flow in the system.

In one embodiment, embedded pump assembly 350 may incorporate: pump 316 comprising, for example, a centrifugal pump or other types of pumps known to those of skill in the art. The pump 316 may be coupled to a discharge pipe 310 to pump fluid from the fluid storage chamber 302 to a distribution system 380 such as a fire sprinkler system.

Pump assembly 350 may further comprise: an anti-reverse check valve 314, isolation valves 306 to isolate system 300 from a distribution system 380, magnetic contactor 334 which may be disposed within electrical control device 312, pressure switch 308 which may be automatically activated when pressure in the system 300 changes by a predetermined amount, pressure gauge 338 to detect system pressure, run period timer 340 which may be disposed within electrical control device 312 to control the run time period and/or control enclosure.

The embedded pump assembly 350 may be disposed such that a fluid flow path from the suction pipe 318 through the discharge pipe 310 by means of the pressure booster embedded pump system 320. In one embodiment, discharge pipe 310 may pass across the length and/or width of the fluid storage chamber 302 along a housing cavity 322 that bisects the fluid storage chamber 302.

In one embodiment, the system 300 may comprise, a discharge manifold incorporating one or more of the following: an anti-reverse valve 314, a mounting plate 336 configured to secure an electrical control device 312, a pressure indicating gauge 390 for detecting fluid pressure in the sprinkler piping system (as illustrated in FIG. 1, element 106), a pressure activated switch 308 configured to activate the pump 316 upon detecting a particular pressure in the sprinkler system by the pressure gauge 390, a system isolation valve 306 configured to isolate the pump 316 from the rest of the pump assembly 350, and one or more flexible couplings and/or a curved elbow part.

In a particular embodiment, fluid storage chamber 302 may comprise a variety of materials such as plastic, rubber or metal or any other suitable materials know to those of skill in the art. The fluid storage chamber 302 may be molded or fabricated or produced by any other means know to those of skill in the art.

The walls 303 and external surface contours 332 of which define the extremities of the chamber 302. The chamber 302 may provide a mounting platform 324 for fluid pump 316. The mounting platform 324 may be disposed in housing cavity 322 bisecting the fluid storage chamber 302 in a horizontal plane 329 such that the vertical outside surface 326, horizontal outside surface 328, and curved surfaces 332 on the external surface of the fluid storage chamber 302 walls comprise the housing cavity 322 to form the mounting platform 324 for the pump 316 and motor 330. In one embodiment, curved surfaces 332 may reinforce vertical surfaces 326 of the fluid storage chamber 302 disposed at connecting ends of housing cavity 322.

In one embodiment, pump 316 and motor 330 may be mounted within this housing cavity 322. Such disposition integrates the functions of fluid storage and fluid pumping into a single unit comprising pump 316, motor 330 configured to reside within the housing cavity 322 mounting platform 324, and tank reinforcement channels 332 into one part.

Integrating the pumping assembly 350 within storage chamber 302 may reduce the footprint of system 300 and protect pumping assembly 350 from potentially damaging exposure to water, chemicals, falling and rolling objects or such other damaging exposures as may impair or destroy the components of the pumping assembly 350.

In one embodiment, the pumping assembly 350 includes a suction pipe arrangement 360 at least one suction pipe 318 such as a length of pipe or hose. The suction pipe 318 may be made of any of a variety of appropriate materials known to those of skill in the art, such as rubber, plastic, polyvinylchloride (pvc) and/or copper, for instance. The suction pipe 318 may be disposed on an intake side of pump 316 and configured to draw fluid from the fluid storage chamber 302 into pump 316.

The pumping assembly 350 further comprises an inlet 319 terminating in a through tank fitting such as a bulkhead or other suitable through tank fitting 356 and an outlet 352 terminating at the inlet connection 354 of pump 316. Inlet 319 to the suction pipe arrangement 360 may include at least one valve mechanism 358 (e.g., a ball valve) designed to isolate the fluid storage chamber 302 from the suction pipe 318.

In one embodiment, the suction pipe arrangement 360 is provided in such a manner to minimize protrusion of any portion of the suction pipe arrangement beyond an outside perimeter of an outline of the base of the fluid storage chamber 302. Such compact housing of the pump assembly within the fluid storage chamber 302 may minimize the footprint 370 of the system 300 and/or protect the pump assembly 350 and suction arrangement 360 from damage. In one embodiment, the footprint 370 may be such that the embedded pump and fluid storage system 300 may fit through a standard doorway in a residence, approximately 32 in×80 in.

In one embodiment, the embedded pump and fluid storage system 300 may comprise an anti-tipping mechanism 351 configured to securely attach the device to a wall within the dwelling structure it is installed within such as a garage, basement, closet, etc.

The mechanism may comprise a device attached to the fluid storage chamber effecting an extension of a vertical side of the rear of the fluid storage chamber projecting beyond the uppermost horizontal surface excluding the lid or vent located on the top of the fluid storage chamber thus providing a means to securely fasten the highest point of the fluid storage chamber to the dwelling structure with screws, nails, or other suitable fasteners for the purpose of discouraging the fluid storage chamber from tipping.

In one embodiment, the embedded pump and fluid storage system 300 may comprise an automatic valve and sensor 317 designed to maintain a maximum level in the fluid in the storage chamber 302 such that the fluid storage chamber 302 may automatically refill if or when the fluid level falls below a threshold level. This may increase the quantity of fluid available to apply to a fire as opposed to a system in which no provisions are made for automatic recharge of the fluid storage chamber 302. In one embodiment, the plumbing system for the residence is the source for automatic refill of fluid storage system 300.

Referring still to FIG. 3, in one embodiment, the system 300 may comprise, a discharge manifold 382 incorporating one or more of the following: an anti-reverse valve 314, a mounting plate 336 configured to secure an electrical control device 312, a pressure indicating gauge for detecting fluid pressure in the sprinkler piping system, a pressure activated switch 308 configured to activate the pump 316 upon detecting a particular pressure in the sprinkler system by the pressure gauge, a system isolation valve 306 configured to isolate the pump 316 from the rest of the pump assembly 350, and one or more flexible couplings and/or a curved elbow part. In one embodiment, one or more flexible couplings are configured for directing the discharge fluid path in any direction from the fluid storage chamber. The flexible couplings may, for instance, provide strain relief for the discharge piping 310 and may operate in conjunction with the curved elbow part.

The pressure activated switch 308 may supply electrical power to the pump motor 330 when fluid pressure in the sprinkler piping falls below a specified pressure and interrupt electrical power to the pump motor 330 when pressure in the sprinkler piping rises above a higher specified limit. The thresholds may be set for a differential pressure of 20 psi (pounds per square inch) such that the pump starts when the pressure falls below 20 psi and stops when the pressure rises above 40 psi, for example.

Figure 3A:
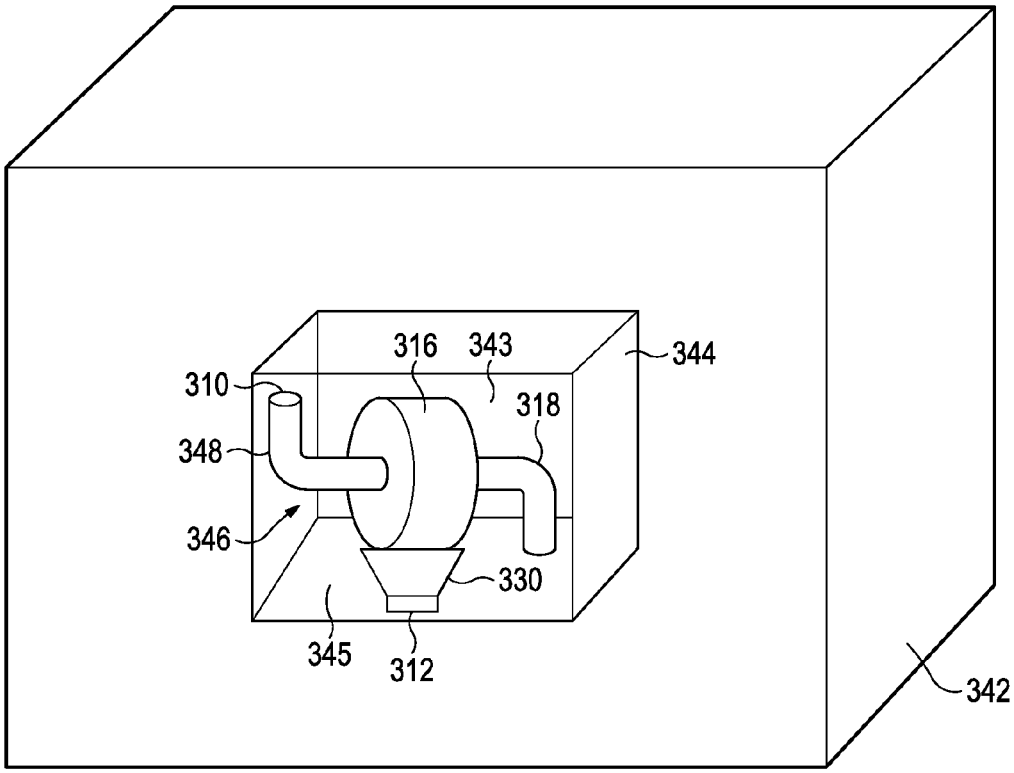
FIG. 3*a* shows an embodiment of an embedded pump and storage assembly.

FIG. 3*a* depicts an embodiment of a fluid chamber 342 comprising an embedded pump housing 344. The housing 344 comprises an inner cavity 346, inner sidewalls 348, interior back wall 343 and mounting platform 345 for mounting fluid pump 316. In one embodiment, mounting platform 345 may be disposed as a cavity, shelf, bench, or ledge integrated into chamber 342. In one embodiment, mounting platform 345 may contain, conceal, support and/or dispose pump 316, motor 330, controls 312, and/or any portion of the suction piping 318 and/or discharge piping 310 partially or substantially within the boundary of the footprint or plan dimension of the fluid storage chamber.

Figure 4:
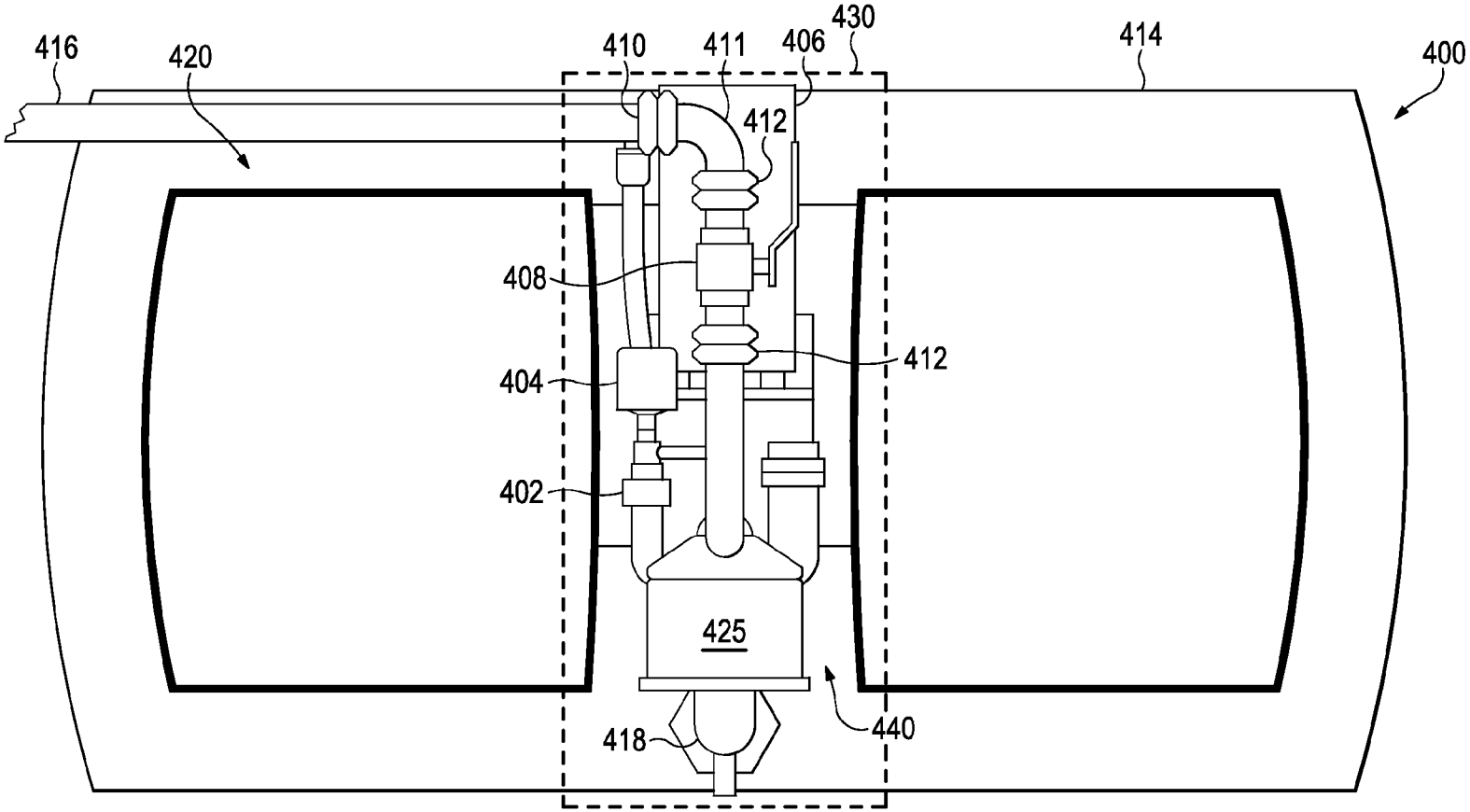
FIG. 4 shows an embodiment of an embedded pump and storage assembly.

FIG. 4 illustrates a cross-sectional side view of an embodiment of an embedded pump and storage system 400, in one embodiment, the system 400 may comprise a pump assembly 430 disposed within a housing cavity 440 embedded within a fluid storage chamber 414.

System 400 may further comprise: a pressure indicating gauge 402 for indicating fluid pressure in the sprinkler piping system a pressure activated switch 404 configured to activate the pump 406 upon detecting a particular pressure in the sprinkler system by the pressure gauge 402, a system isolation valve 408 configured to isolate the pump 406 from the rest of the storage system 400, and one or more flexible couplings 410 and 412 and/or a curved elbow part 411. In one embodiment, the one or more flexible couplings 410 and 412 are configured for directing the discharge fluid path in any direction from the fluid storage chamber 414. The flexible couplings 410 and 412 may, for instance, provide strain relief for the discharge piping 416 disposed in discharge channel 420 and may operate in conjunction with the curved elbow part. Suction pipe 418 and electric control device 425 are also shown.

Figure 5:
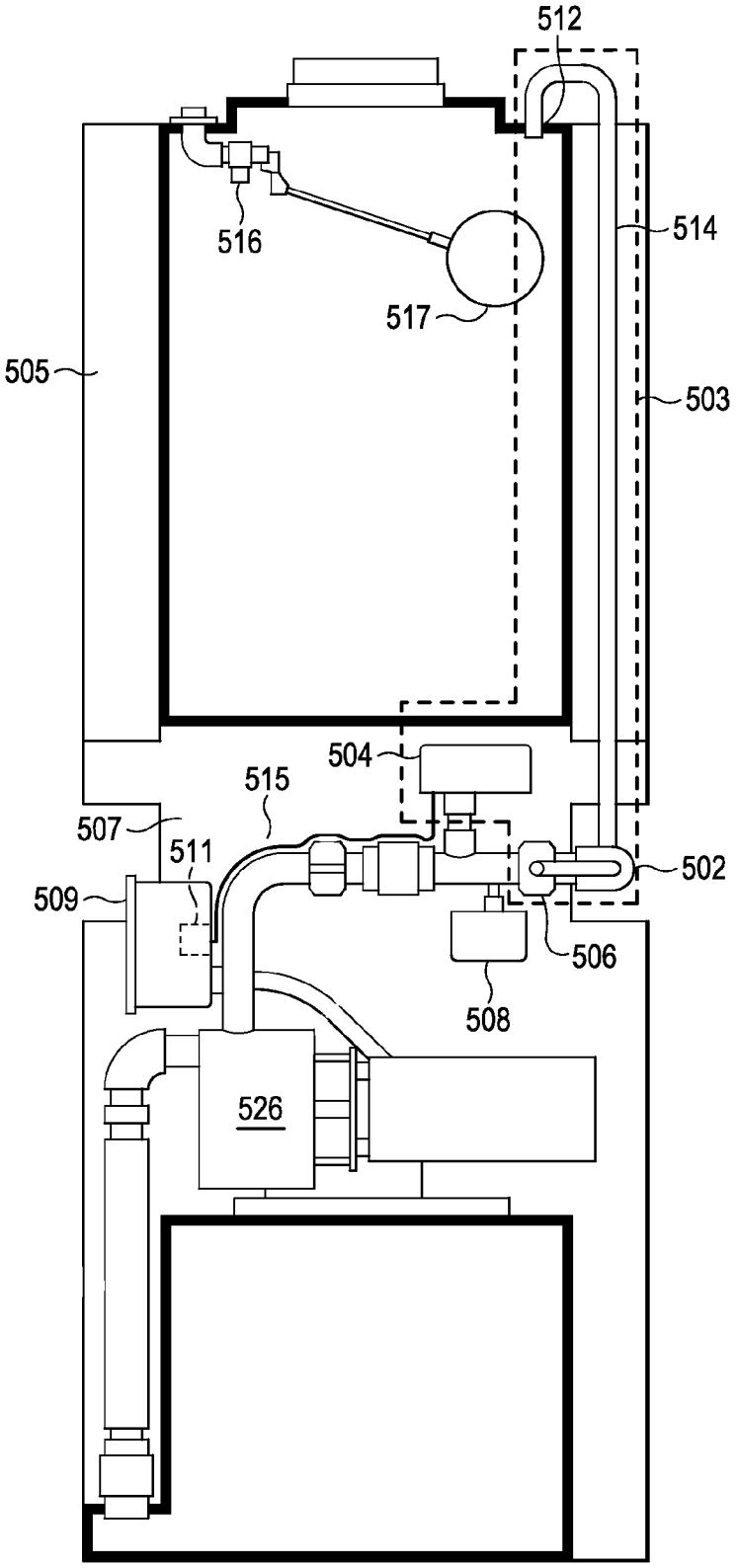
FIG. 5 shows an embodiment of an embedded pump and storage assembly.

FIG. 5 illustrates another embodiment an embedded pump and storage system 500. System 500 may comprise an integrated sprinkler riser assembly 503 including a flow sensor 504, test drain valve 506 and pressure-actuating switch 508. System 500 may also include a test drain assembly 510 having a test orifice 512, test drain tube 514 and test drain valve 506. The test drain assembly 510 is configured for testing of embedded pump system 526 and fluid flow alarm switch 712.

In one embodiment, for testing the test orifice 512 is fitted with a smallest sprinkler head used in a corresponding distribution system.

In one embodiment, embedded pump and storage system 500 incorporates a flow sensor 504 to send a signal through a parallel circuit 515 to the contactor 511 inside of 509. With that of the pressure switch 508 to prevent the embedded pump from cycling on and off repeatedly during system testing, when flow is present or during low or no flow demands.

In one embodiment, fluid chamber 502 may include, fluid level sensing mechanism 517 for actuating an automatic water fill valve 516. Fill valve 516 may connect the fluid storage chamber 505 to a pressurized water supply source from the residential plumbing system in order to replenish water in the fluid storage chamber 505 as it becomes depleted.

In one embodiment, an integrated sprinkler riser assembly 503, flow switch 504, and test drain assembly 510 are configured such that: (1) the entire assembly may be contained within the housing cavity 507 bisecting and integrated into the fluid storage chamber 505 thereby reducing a need for additional space and attendant poor aesthetic appearance within the dwelling that would be imposed by an externally mounted arrangement fabricated on site 2) the entire assembly can be tested before shipping to assure proper adjustment and operation by qualified personnel (3) this arrangement may reduce installation time and cost.

Figure 7:
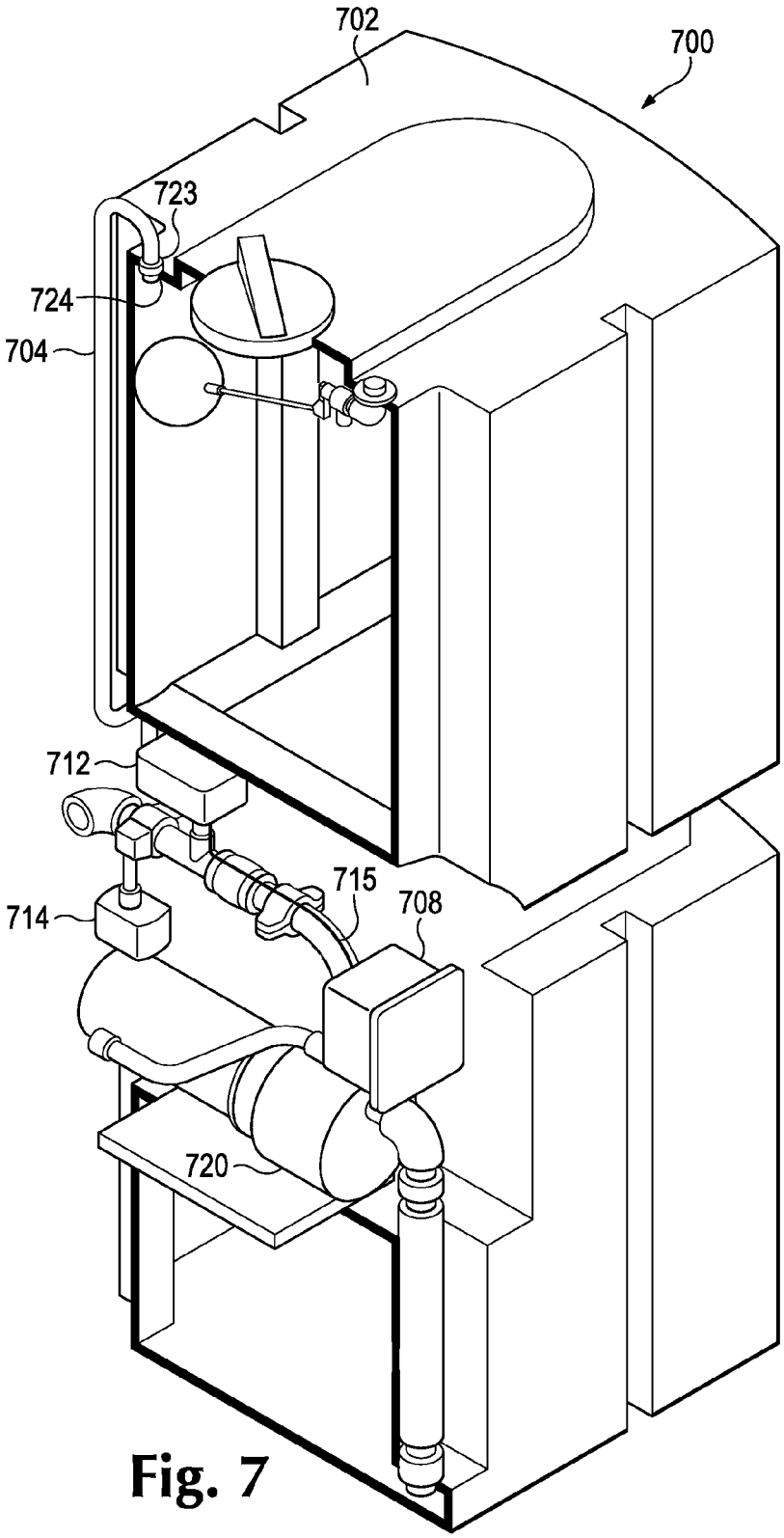
FIG. 7 shows an embodiment of an embedded pump and storage assembly.

FIG. 7 illustrates a front sectional view of an embodiment of an embedded pump and storage system 700. In one embodiment, a flow metered test drain discharge assembly includes a test drain 704 that directs discharge from the open test drain valve (element 506 in FIG. 5) to the fluid storage chamber 702.

In one embodiment, a flow tube 704 connected from the discharge of the test drain control valve 506 and terminating at a fitting 723 attached to the top of the fluid storage chamber 702. The fitting 723 at the top of the fluid storage chamber is configured and disposed for providing a connection of a test orifice 724 within the interior of the fluid storage chamber 702 such that the test assembly may simulate a system flow rate demand. In one embodiment, the demand simulated may be equal to the demand that would be required by the lowest demand of any sprinkler head installed in the sprinkler system.

Figure 6:
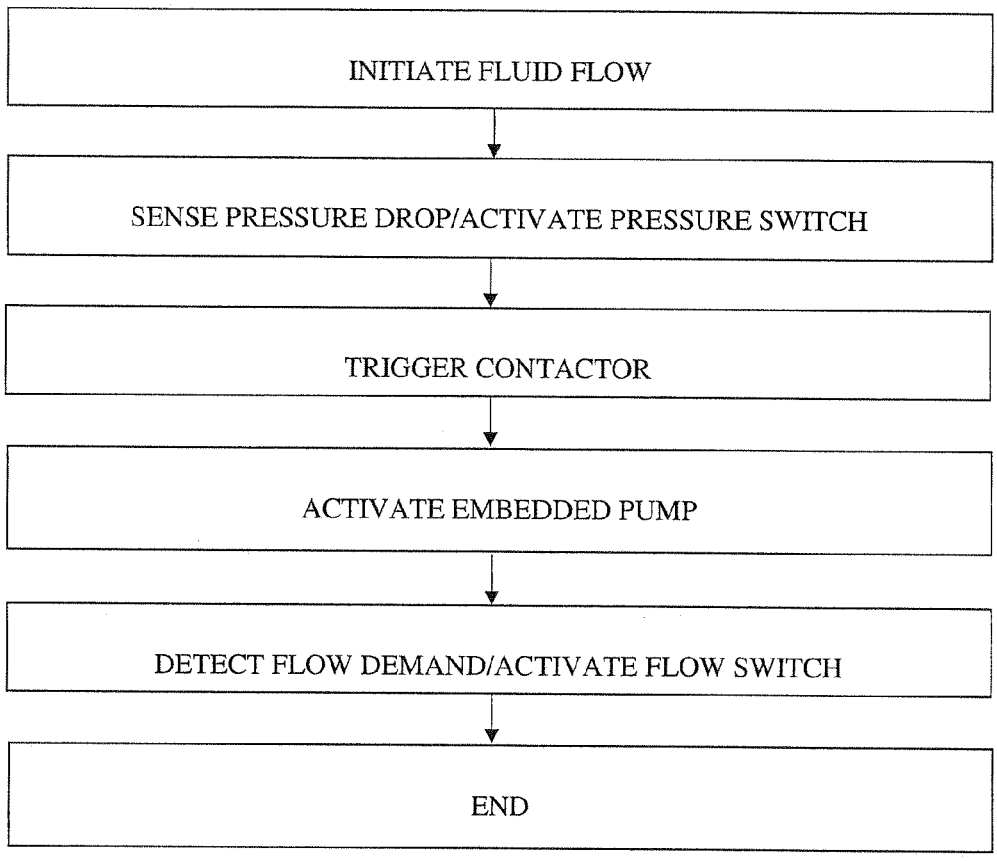
FIG. 6 is a flow diagram illustrating a process for controlling a fluid pumping system.

FIG. 6 is a flow diagram illustrating an embodiment of an embedded pump and storage system 700 as depicted in FIG. 7 during a fluid flow condition. Process 600 shows how the flow sensor 712 and parallel circuit 715 are configured to prevent accidental on/off cycling of the embedded pump 720.

Beginning from a fully charged system in a static condition, at box 602 fluid flow is initiated, for instance by, opening of test drain valve (see element 506, FIG. 5) or activation of a sprinkler head in the distribution system. The process flows to box 604, where the resulting drop in system pressure may be sensed and may activate pressure switch 714.

At box 606, pressure switch 714 triggers embedded pump run contactor in flow control box 708 and thereby activates the embedded pump 720 at box 608. The embedded pump then may start.

At box 610, upon executing an embedded pump start condition and detecting whether there is a demand for increased flow in the system. If detected, flow switch 712 may activate and provide a parallel control signal along circuit 715. Circuit 715 may run in parallel with pressure switch 714. In one embodiment, flow may be detected by using a "paddle" inserted into the flow path that activates whenever there is flow in the system greater than a predetermined threshold, such as, for instance, six GPM (gallons per minute).

In one embodiment, flow switch 712 may be an alarm. A parallel control circuit may include one or more on/off signals arranged in parallel such that an "on" signal from one or more of the circuits may cause the pump 720 to run. The process 600 ends at box 612.

In one embodiment, the parallel control circuit 715 from the activated flow switch 712 may maintain control voltage to the embedded pump run contactor inside flow control box 708 thereby preventing the embedded pump run contactor from opening and maintaining the embedded pump 720 in a running condition regardless of the on/off state of the pressure switch 714.

Such a running condition may persist until both the pressure switch 714 and the flow switch 712 are de-activated, for instance, when flow demand equals approximately zero and the system pressure overcomes the setting of the pressure switch. In this embodiment, both the flow switch 712 and pressure switch 714 may be de-activated thus removing both run signals. The flow switch 712 may be de activated due to lack of fluid flow in the system 700. The pressure switch 714 may be de-activated because the system pressure is higher than the de-activate setting of the pressure switch 714.

Figure 8:
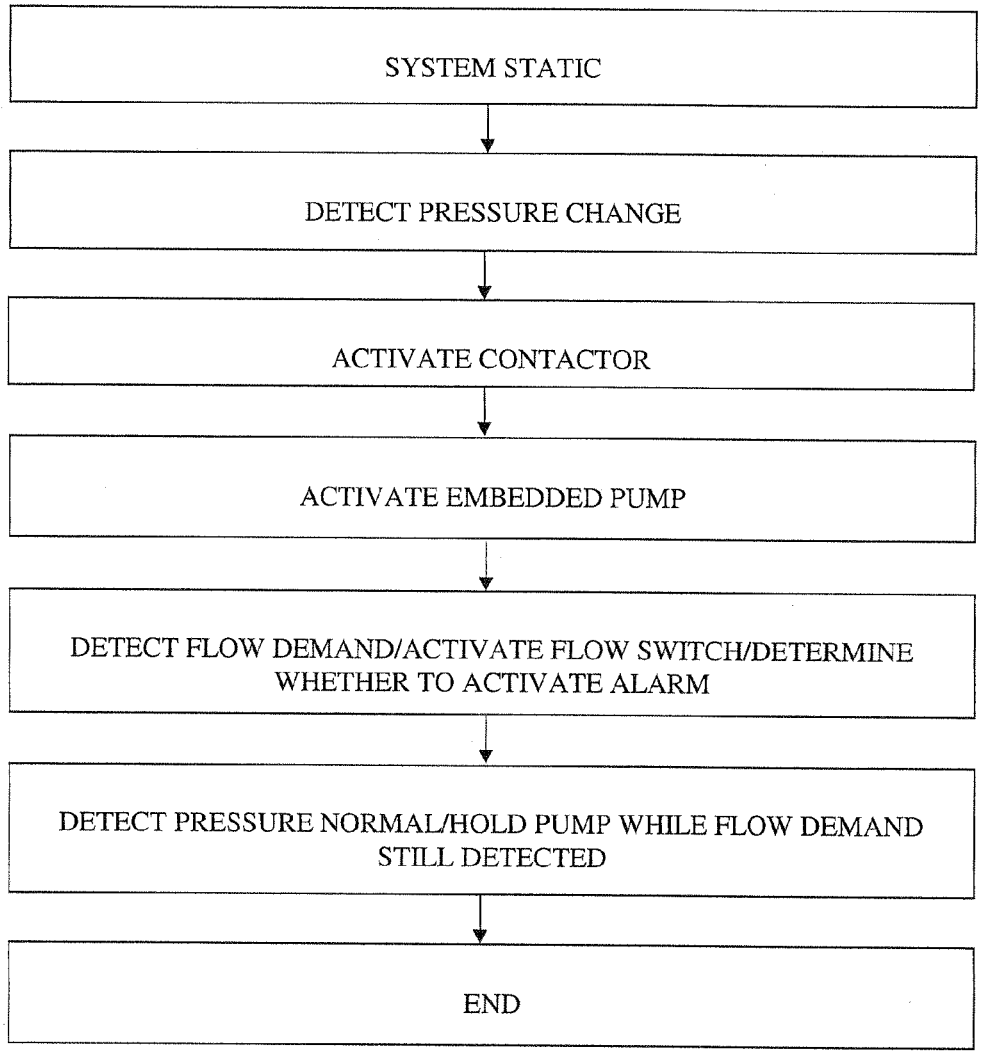
FIG. 8 is a flow diagram illustrating a process for controlling a fluid pumping system.

FIG. 8 is a flow diagram illustrating an embodiment of an embodiment of an embedded pump and storage system 700 (see FIG. 7) during a fluid flow condition. Process 800 begins at block 802 where operation of embedded pump and storage system 700 during a test begins with a fully charged system in a static condition. A pressure change in the system may be triggered, for instance, by opening of the test drain control valve (see element 506 in FIG. 5) or due to other causes such as a system pressure recharge condition in which the system pressure drops over time due to a leak or possibly the assimilation/absorption of air/gas trapped in the system into the water in the system for example. At block 804, a pressure sensor of pressure switch 714 detects a pressure drop in the system. At block 806, responsive to the pressure drop the pressure switch 714 activates the embedded pump run contactor in the control box 708. The run contactor triggers the embedded pump 720 to start which initiates fluid flow at block 808.

In one embodiment, the embedded pump 720 may be activated to pump at a rate proportional to the pressure drop such that the system may be restored to a pressure within an accepted threshold within a predetermined time period. Thus, for a particular pressure drop the pump 720 may pump faster or a greater volume than for smaller pressure drops during a same pumping time period.

In one embodiment, at block 808, upon activating the embedded pump start condition due to a drop in system pressure actuating the pressure switch 714 there is a flow demand in the system due to the opening of test drain control valve 506 or other cause of flow demand.

At block 810, the flow demand is sensed and activates flow switch 712 triggering a control circuit in the control box 708 that is provided in parallel with the pressure switch 714. The parallel control circuit from the activated flow switch 712 will maintain control voltage to the embedded pump run contactor inside the control box 708 thereby preventing the embedded pump run contactor from opening. Thus, the contactor can't open because the flow switch 712 is activated keeping the contactor in flow controller 708 activated. Therefore, the embedded pump 714 may continue running regardless of the on/off state of the pressure switch 508. Thus, even if the pressure in the system de-activates the pressure switch the embedded pump system 720 may continue running until the test drain control valve 506 is manipulated into the closed position or other cause of a flow condition in the system 700 is reversed. Accordingly, at block 812, pressure returns to system normal and flow ceases. When the flow ceases both the pressure switch 714 and the flow switch 712 are no longer activated. At block 814, the pressure switch 714 and the flow switch 712 and corresponding run input voltages are no longer activating the embedded pump run contactor of flow controller 708. Thus, the embedded pump system 720 stops pumping.

Referring still to FIG. 8, in another embodiment, fluid flow may be caused by activation of the associated distribution system such as a fire causing sprinklers to activate or a system drain test. These flow conditions may also trigger an electrical output signal from flow switch 712 signaling the flow condition. The output signal may activate an alarm. In one embodiment, the output signal may be initiated by an instantaneous closure of electrical contacts within the flow switch 712 upon detection of flow in the system.

In some embodiments it may not be desirable that this condition should be instantly converted into a flow output alarm signal to either a local alarm warning device or to a remote monitoring station due to the possibility that the flow switch may become momentarily activated upon a system pressure recharge condition as opposed to a true and sustained flow condition. In order to prevent a "false" alarm, the alarm output signal may be dependent upon the flow switch 714 being continuously activated for a predetermined period of time, for example 30 seconds, before a system flow output alarm signal is delivered.

This can be accomplished by imposing a time delay on the flow switch output signal dedicated to the alarm function by the use of a flow alarm time delay electrical relay this relay can therefore be initialized by the same flow switch output contacts used to maintain the embedded pump run contactor in the running position for the duration of the flow period with the benefit that no additional flow sensing output device is required to fulfill the dual functionality of a flow sensing indicator employed in the dual roles described herein.

Figure 9:
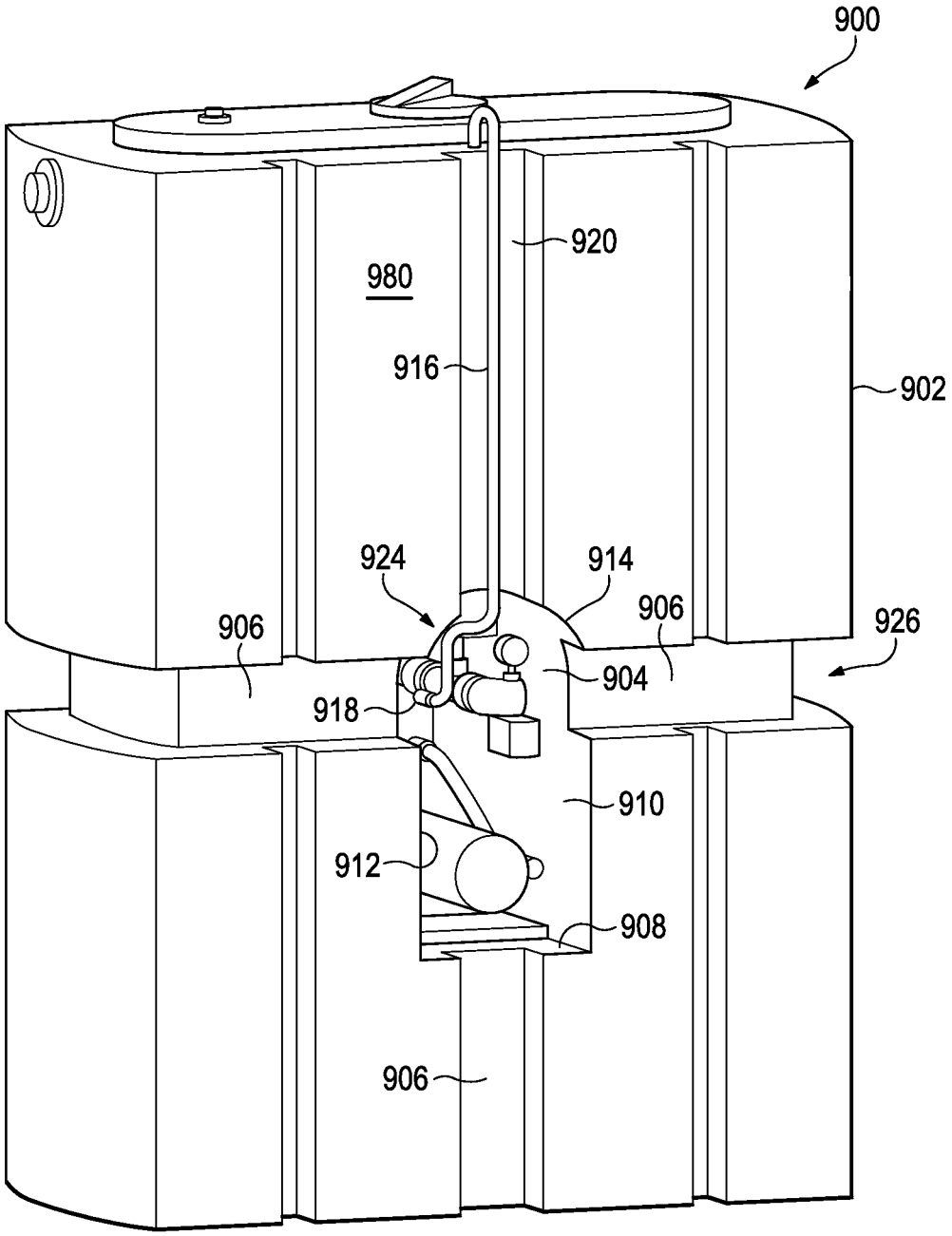
FIG. 9 shows an embodiment of an embedded pump and storage assembly.

FIG. 9 illustrates an embodiment of an embedded pump and storage system 900. In one embodiment, the fluid storage chamber 902 comprises a fluid storage chamber pump mounting passageway 904 including a mounting plate 908, at least two vertical interior walls 910 and 912 and an interior overhead housing arc 914. Test drain 916 is shown extending vertically from embedded pump system 918 mounted on mounting plate 908. Test drain 916 runs to a top surface of fluid storage chamber 902 in channel 920 along the exterior sidewall 980 of fluid chamber 902. Passageway 904 may extend through fluid chamber 902, or may be enclosed on a backside 924 of fluid chamber 902. Additional channels 906 and 926 provide support for fluid chamber 902 as well as provide a space for fitting discharge piping (see element 218 of FIG. 2) or suction piping (see element 318 of FIG. 3) to run along the exterior portion of fluid chamber 902.

Figure 10:
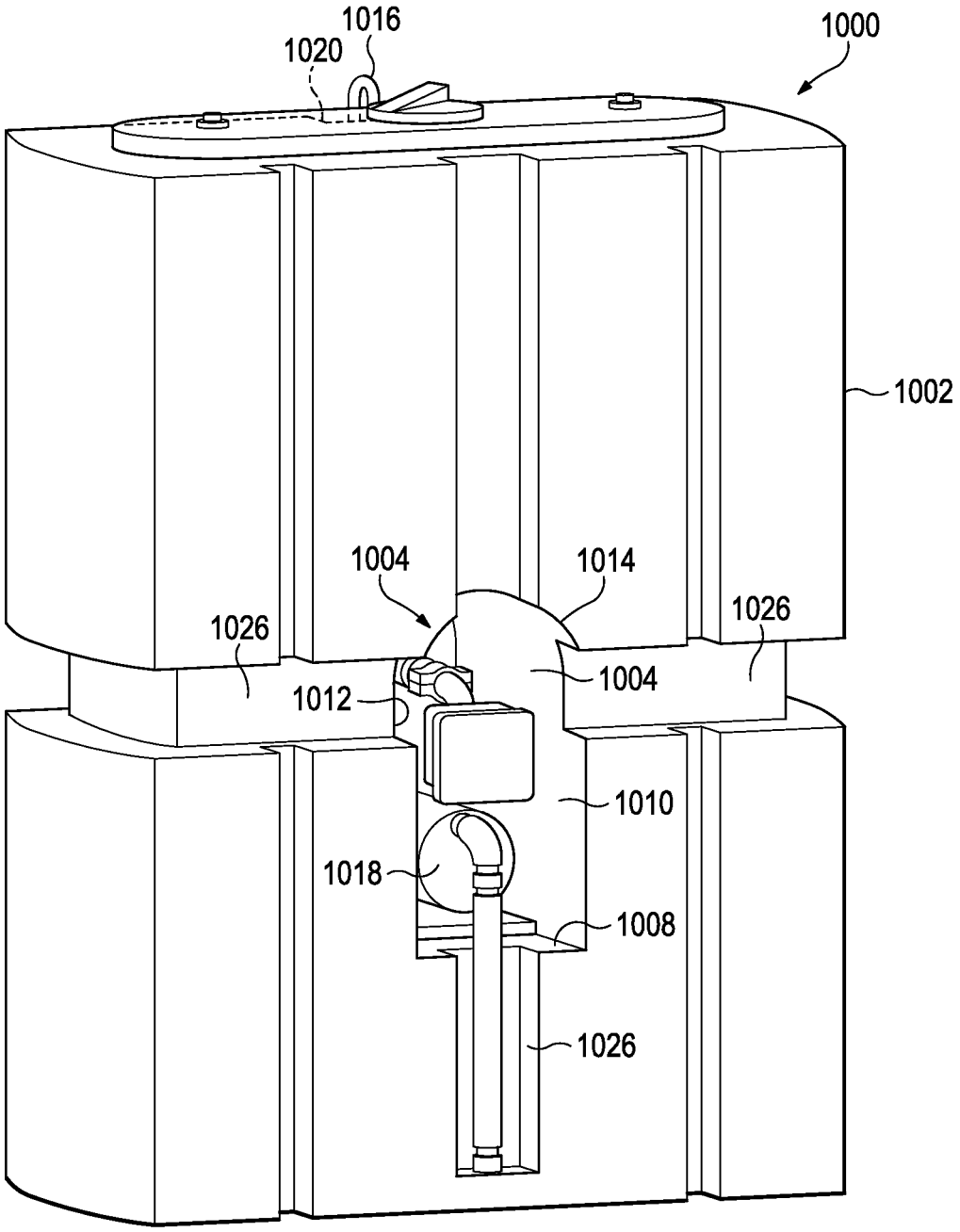
FIG. 10 shows an embodiment of an embedded pump and storage assembly.

FIG. 10 illustrates an embodiment of an embedded pump and storage system 1000. In one embodiment, the fluid storage chamber 1002 comprises a fluid storage chamber pump mounting passageway 1004 including a mounting plate 1008, at least two vertical interior walls 1010 and 1012 and an interior overhead housing arc 1014. Test drain 1016 is shown extending vertically from embedded pump system 1018 mounted on mounting plate 1008. Test drain 1016 runs behind fluid storage chamber 1002 in channel 1020 along the exterior sidewall of fluid chamber 1002. Passageway 1004 may extend through fluid chamber 1002, or may be enclosed on a backside of fluid chamber 902. Additional channels 1026 provide support for fluid chamber 1002 as well as provide a space for fitting discharge piping (see element 218 of FIG. 2) or suction piping (see element 318 of FIG. 3) to run along the exterior portion of fluid chamber 1002.

Having described and illustrated the principles of the fluid storage and embedded pumping assembly for fire prevention and protection and certain embodiments thereof, it should be apparent that the fluid storage and embedded pumping assembly for fire prevention and protection may be modified in arrangement and detail without departing from such principles. I claim all modifications and variation coming within the spirit and scope of the following claims.

The invention claimed is:

1. A tank for a fluid storage assembly, the tank comprising: a housing cavity configured to have disposed therein a fluid pumping assembly; and an exterior surface defining a channel configured to have disposed therein at least one of first piping of an ingress portion of the fluid pumping assembly or second piping of an egress portion of the fluid pumping assembly.

2. The tank of claim 1, wherein the housing cavity bisects the tank.

3. The tank of claim 1, wherein the housing cavity is inset within the tank and is disposed within an exterior boundary of the tank.

4. The tank of claim 1, wherein the housing cavity defines a support base for the fluid pumping assembly.

5. The tank of claim 1, wherein a dimension of the tank is less than or equal to 32 inches wide.

6. A fluid storage assembly comprising: a tank comprising a housing cavity; and a fluid pumping assembly disposed within the housing cavity; wherein an exterior surface of the tank defines a channel configured to have disposed therein at least one of first piping of an ingress portion of the fluid pumping assembly or second piping of an egress portion of the fluid pumping assembly.

7. The fluid storage assembly of claim 6, wherein the housing cavity bisects the tank.

8. The fluid storage assembly of claim 6, wherein the housing cavity is inset within the tank and is disposed within an exterior boundary of the tank.

9. The fluid storage assembly of claim 6, wherein the at least one channel is configured to provide structural support to the tank.

10. The fluid storage assembly of claim 6, wherein the housing cavity defines a support base for the fluid pumping assembly.

11. A fluid storage assembly, comprising: a tank comprising a housing cavity; and means for supporting a fluid pumping assembly within the housing cavity; wherein an exterior surface of the tank defines a channel configured to have disposed therein at least one of first piping of an ingress portion of the fluid pumping assembly or second piping of an egress portion of the fluid pumping assembly.

12. The fluid storage assembly of claim 11, wherein the housing cavity bisects the tank.

13. The fluid storage assembly of claim 11, wherein the housing cavity is inset within the tank and is disposed within an exterior boundary of the tank.

14. The fluid storage assembly of claim 11, wherein the at least one channel is configured to provide structural support to the tank.

15. The fluid storage assembly of claim 11, wherein the tank is less or equal to 32 inches wide.

* * * * *